US009474396B2

(12) United States Patent
Russell

(10) Patent No.: US 9,474,396 B2
(45) Date of Patent: Oct. 25, 2016

(54) PILLOW COVER WITH SIDE GUSSETS AND METHOD OF CONSTRUCTION

(71) Applicant: William Earl Russell, Tunnel Hill, GA (US)

(72) Inventor: William Earl Russell, Tunnel Hill, GA (US)

( * ) Notice: Subject to any disclaimer, the term of this patent is extended or adjusted under 35 U.S.C. 154(b) by 0 days.

(21) Appl. No.: 14/276,209

(22) Filed: May 13, 2014

(65) Prior Publication Data

US 2014/0338130 A1 Nov. 20, 2014

Related U.S. Application Data

(60) Provisional application No. 61/823,212, filed on May 14, 2013.

(51) Int. Cl.
*A47G 9/10* (2006.01)
*D05B 13/02* (2006.01)

(52) U.S. Cl.
CPC ..... *A47G 9/10* (2013.01); *D05B 13/02* (2013.01)

(58) Field of Classification Search
CPC ..... A47G 9/10; A47G 9/00; D05B 13/02; B65D 85/16
USPC ..... D6/601
See application file for complete search history.

(56) References Cited

U.S. PATENT DOCUMENTS

| | | | | | |
|---|---|---|---|---|---|
| 1,876,591 | A * | 9/1932 | Bawden | A47G 9/10 | 5/490 |
| 2,589,303 | A * | 3/1952 | Sourbeck | A47G 9/10 | 5/645 |
| 3,109,182 | A * | 11/1963 | Doak | A47C 27/22 | 5/636 |
| 4,007,503 | A * | 2/1977 | Watkin | A47G 9/10 | 5/490 |
| 4,420,847 | A * | 12/1983 | Smith | A47G 9/0253 | 5/485 |
| 5,729,851 | A * | 3/1998 | Hollander | A47G 9/10 | 29/91.1 |
| 6,760,935 | B1 * | 7/2004 | Burton | A47G 9/10 | 5/636 |
| D507,920 | S * | 8/2005 | Mack | D6/601 | |
| 8,646,134 | B1 * | 2/2014 | Alletto, Jr. | A47G 9/10 | 5/490 |
| D722,239 | S * | 2/2015 | Russell | D6/601 | |
| 2007/0220678 | A1 * | 9/2007 | Ciliento | A47G 9/10 | 5/636 |
| 2008/0010750 | A1 * | 1/2008 | Tidwell | A47D 13/08 | 5/655 |
| 2013/0340172 | A1 * | 12/2013 | Chen | A47G 9/10 | 5/636 |

* cited by examiner

*Primary Examiner* — David E Sosnowski
*Assistant Examiner* — Myles Throop
(74) *Attorney, Agent, or Firm* — Miller & Martin PLLC

(57) ABSTRACT

A novel pillow cover is provided that can be manufactured so that a finished gusseted pillow produced from four rectangular fabric pieces with only six straight line seams.

15 Claims, 6 Drawing Sheets

PILLOW COVER WITH SIDE GUSSETS AND METHOD OF CONSTRUCTION

This application claims priority to U.S. Provisional Application Ser. No. 61/823,212 filed May 14, 2013.

FIELD OF THE INVENTION

The present invention is concerned with a novel configuration and method of construction of a pillow shell design for filled bed pillows.

BACKGROUND OF THE INVENTION

Conventional pillow shells for bed pillows are most commonly made from only two rectangular sheets of fabric that are sewn together around three edges, inverted, filled with polyester or other suitable material such as down or foam, and then the final seam is sewn with whip stitching or serged. The result is a single four seam bed pillow. The sizes of these rectangular bed pillows range from standard 20×26 inches to jumbo at 20×28 inches, queen 20×30 inches, king at 20×36 inches and body at 20×54 or 20×60 inches. Many factors are significant when designing a bed pillow shell. On the one hand, it is desirable to create pillow shells that produce a distinctive visual appearance while easily accepting the necessary fill material, but on the other hand, it is necessary that the cost of manufacture be very nearly the same as the cost of the simple four seam rectangular pillow design. Numerous attempts have been made to create different appearances both for manufacturing efficiencies such as in U.S. Publication 2009/0106904 where a pillow is provided with rounded corners for ease of uniform filling, to U.S. Pat. No. 6,760,935 where a pillow is provided with four side gusset panels, and to U.S. Design Patent D507,960 where a pillow is provided with two oval side gusset panels and decorative piping. All of these previous designs suffer from various shortcomings including the complications of sewing curved seams, the material wasted when cloth is cut in curved segments, the numbers of seams required to be sewn, and the lack of adaptability to produce a variety of visual appearances. It would be desirable to have a new pillow shell configuration that could be easily manufactured with a limited number of straight seams and no wasted cloth due to using curved fabric pieces in the patterns.

BRIEF DESCRIPTION OF THE INVENTION

Accordingly, the pillow shell and bed pillow described herein can be manufactured from four rectangular pieces of cloth and six straight line seams with minimal labor and little wasted fabric. Furthermore, the pillow shell creates a novel pillow shape and provides the opportunity to display side gusset panels in a distinctive fashion thereby providing a low cost pillow shell and new and distinctive bed pillow designs.

DETAILED DESCRIPTION OF THE INVENTION

Figure 1:
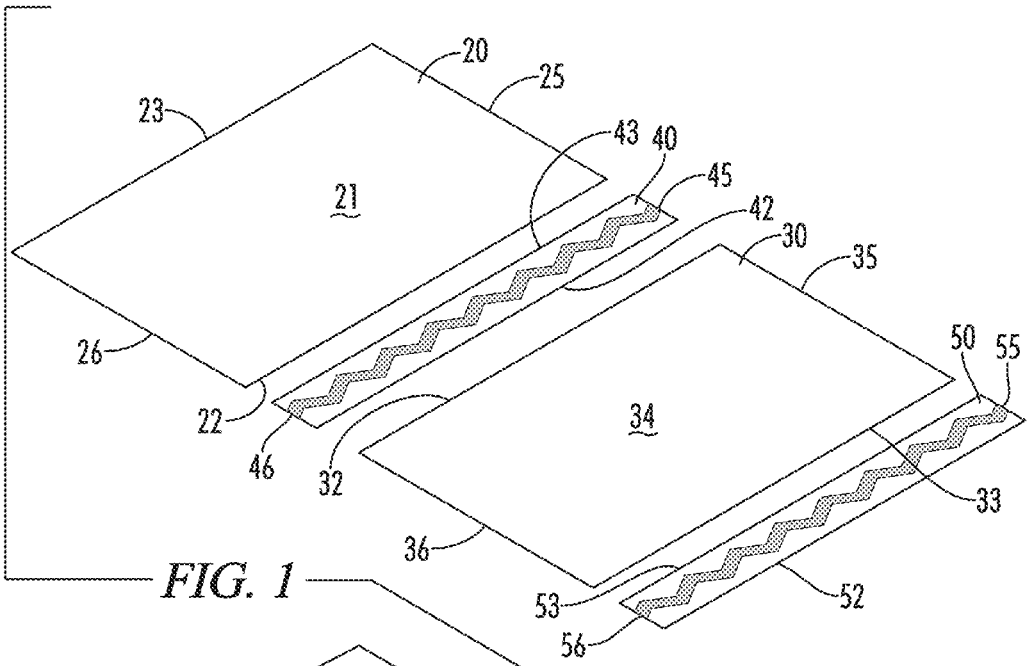
FIG. 1 is a perspective view of four rectangular pieces of fabric for manufacture of a pillow shell according to the present invention.

Turning then to FIG. 1, it can be seen that there are four rectangular fabric pieces, namely, top panel 20, bottom panel 30, first side gusset 40, and second side gusset 50. Each panel is manufactured to have approximately ½ inch extra width and length to allow for ¼ inch seams along each side. Thus, in order to make a jumbo pillow shell that will be approximately 20 inches×28 inches, the length along the lateral edges of each fabric rectangle will be approximately 28.5 inches. If the side gussets are desired to be approximately 3 inches in manufactured condition, then the width of the transverse edges side gussets 40, 50 will be approximately 3.5 inches. A typical finished gusset's width will be between about 1 to 3 inches. Because the gusset in the finished pillow shell creates an inwardly facing concave curve (or outwardly facing convex curve) rather than forming a vertical sidewall, the gusset provides not only additional height to the pillow, but additional width as well. Thus, in order to create a jumbo pillow shell approximately 20 inches wide, with 3 inch gussets, it is only necessary that the top and bottom panels 20, 30 be approximately 17.5 inches wide. As manufactured, the pillow will be 17×3 (gusset)×28. For a one inch gusset, the gusset fabric would be 1.5 inches wide and the top and bottom fabric panels would be 19.5 inches wide resulting in a 19×1×28 pillow shell.

Fabrication of the pillow shell involves joining the lateral edges of the fabric panels using the gusset panels 40, 50 to connect the top and bottom panels 20, 30 and form a fabric loop. As initially laid out in FIG. 1 for fabrication according to one possible method, the gusset panels 40, 50 are placed with their outward facing sides 44, 54 downward on the outward facing side 34 of the back panel 30. It can be seen that the lengths, and corresponding lateral edges of all of the fabric panels 20, 30, 40, 50 are the same. Also the widths, and corresponding transverse edges, of the gusset panels 40, 50 are the same, as are the widths and transverse edges of the top and bottom panels 20, 30. Generally the widths of the top and bottom panels 20, 30 are significantly greater than the widths of the gusset panels 40, 50.

Figure 2:
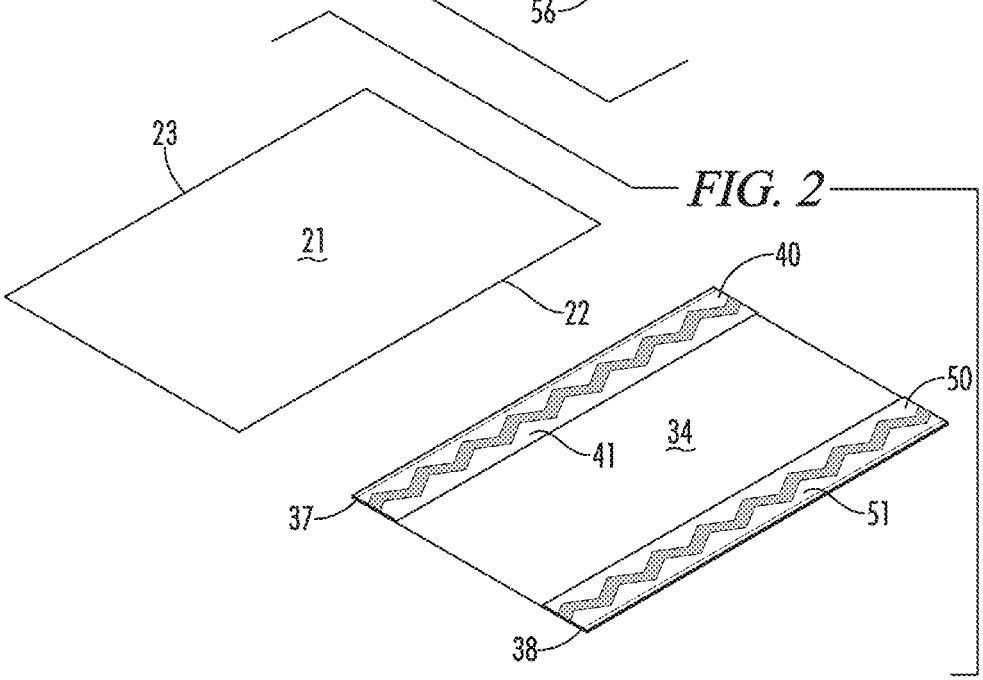
FIG. 2 illustrates the four fabric pieces of FIG. 1 with two gusset pieces attached along first lateral edges to the bottom panel.
Figure 3:
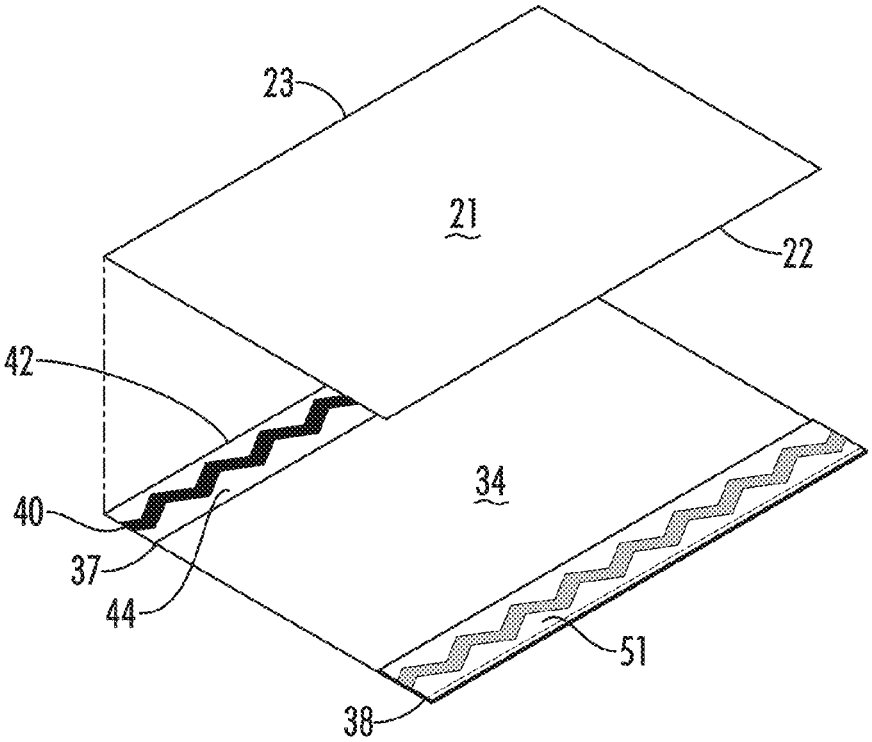
FIG. 3 illustrates the fabric pieces with first gusset piece positioned for attachment along its second lateral edge to the top panel.
Figure 4:
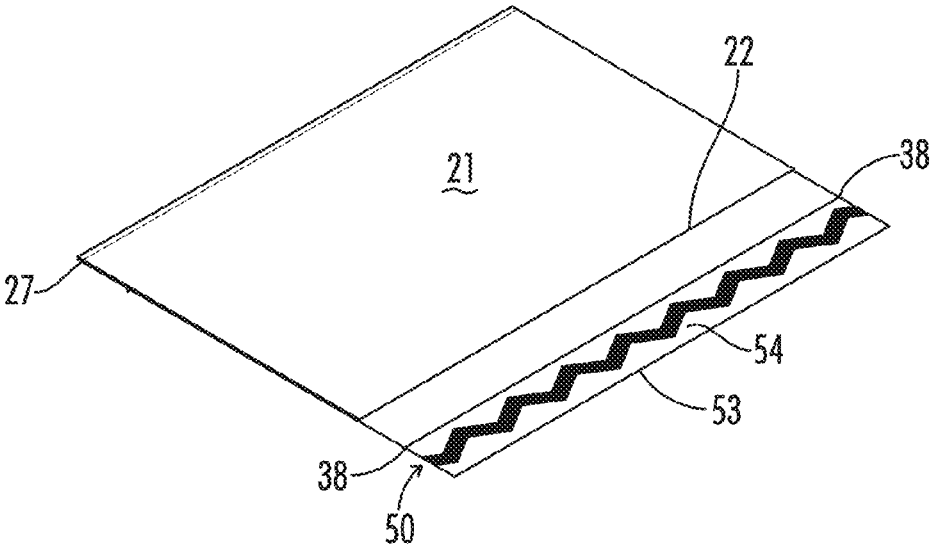
FIG. 4 illustrates the fabric pieces with second gusset piece positioned for attachment to the top panel along its second lateral edge.
Figure 5:
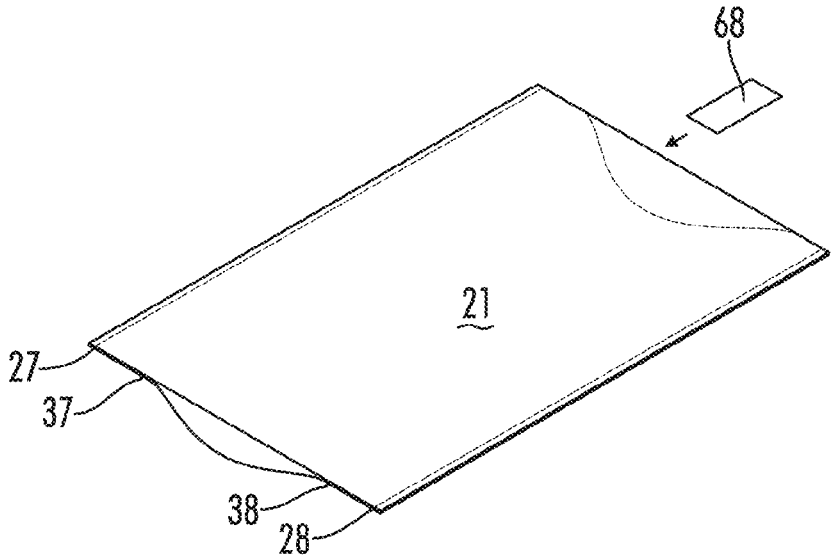
FIG. 5 illustrates the pillow shell assembly after sewing the second lateral edge of the second gusset piece to the top panel.
Figure 6:
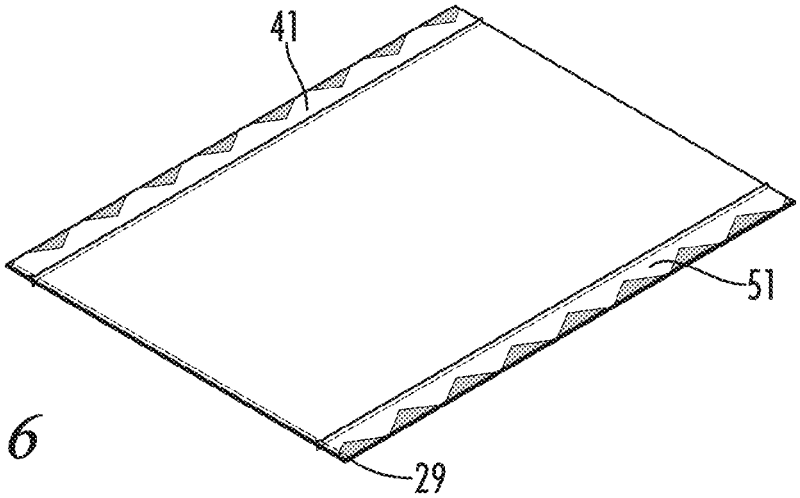
FIG. 6 illustrates the pillow shell assembly from FIG. 5 flattened with one closed end seam and the four gusset seams on the exterior of the shell.
Figure 7:
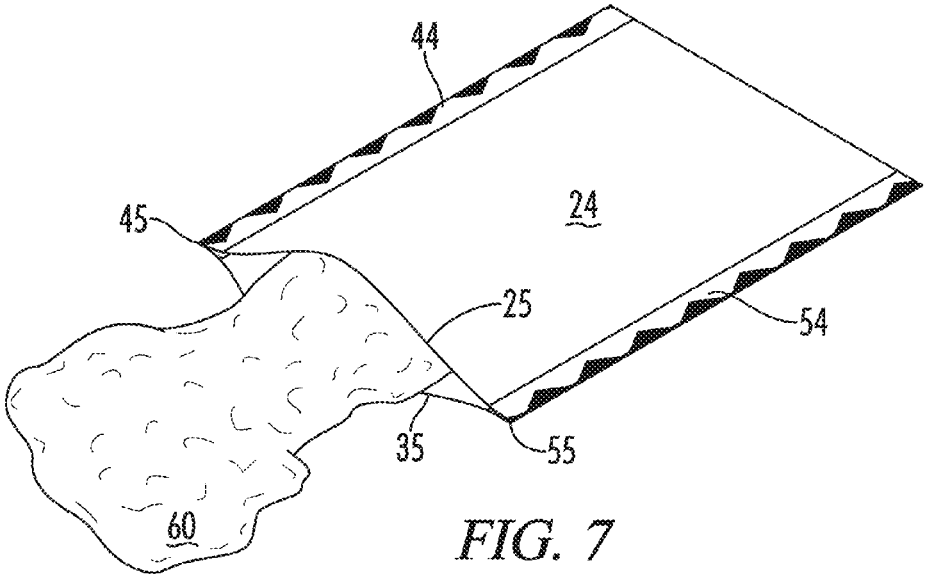
FIG. 7 illustrates the insertion of the fill material after the pillow shell assembly has been inverted.
Figure 8:
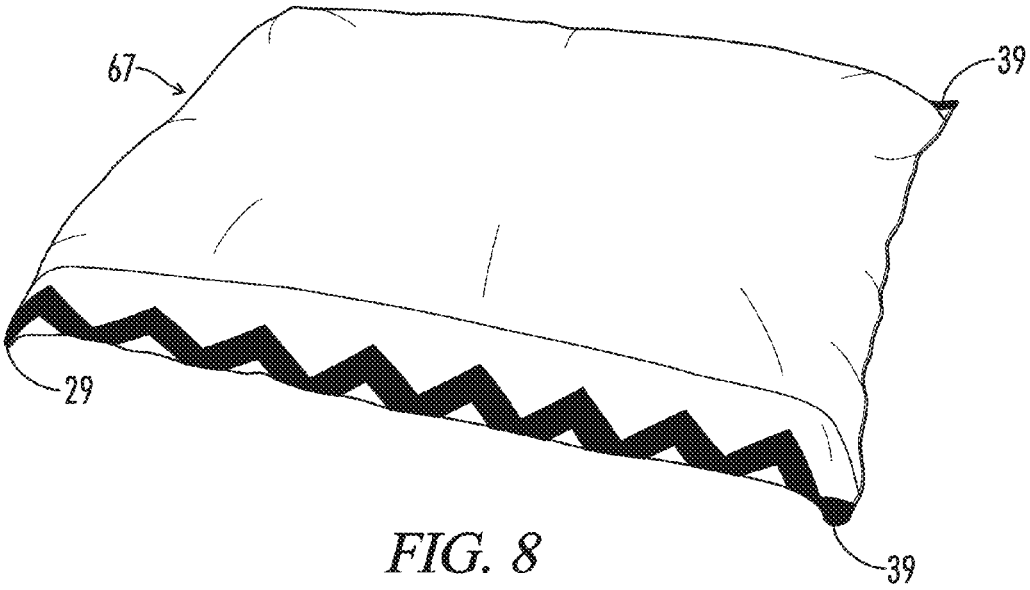
FIG. 8 illustrates the filled pillow shell with the final top seam having been serged.
Figure 9:
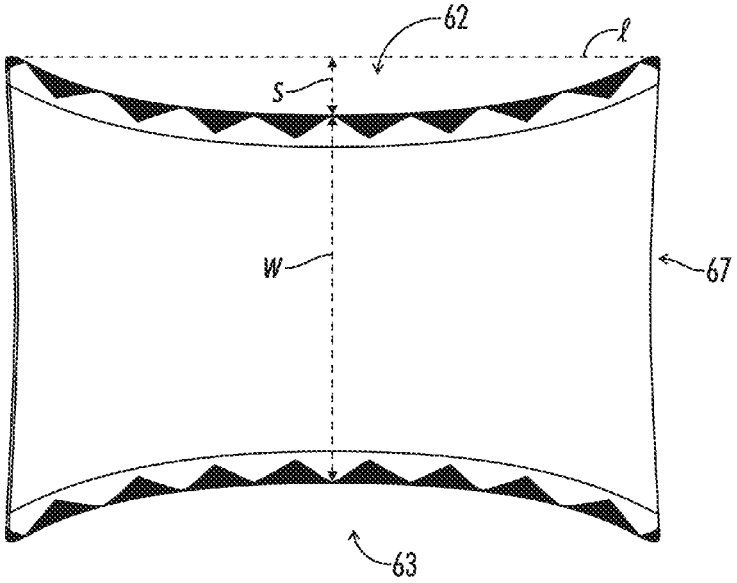
FIG. 9 is a top plan view of a pillow made from a pillow shell according to the invention, the bottom plan view being identical thereto.
Figure 10A:
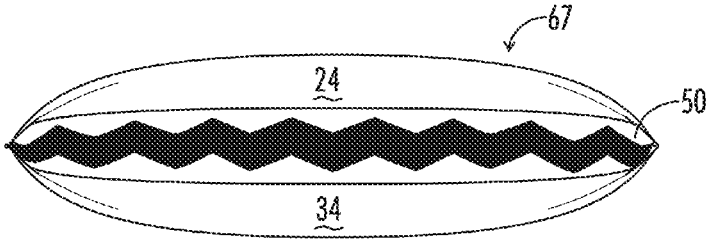
FIG. 10A is a right side view of a pillow made from a pillow shell according to the invention, the left side view being a mirror image thereof.
Figure 10B:
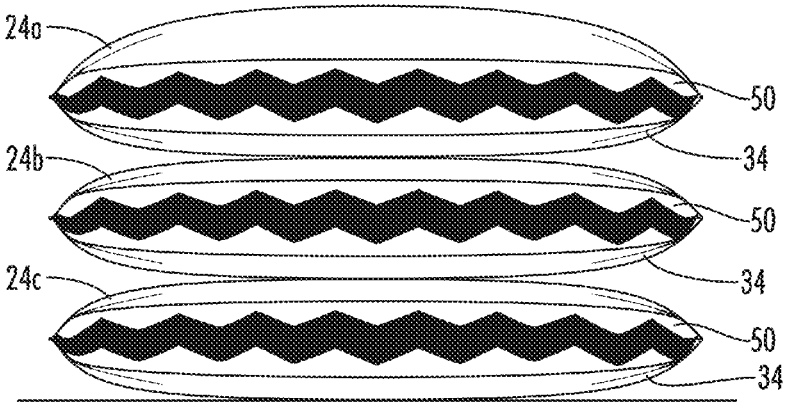
FIG. 10B is a right side view of a plurality of the pillows of FIG. 10A in a vertical stack.
Figure 11:
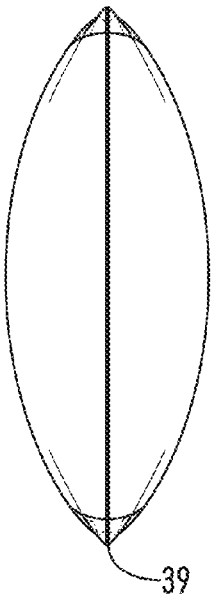
FIG. 11 is a front plan view of a pillow made from a pillow shell according to the present invention.
Figure 12:
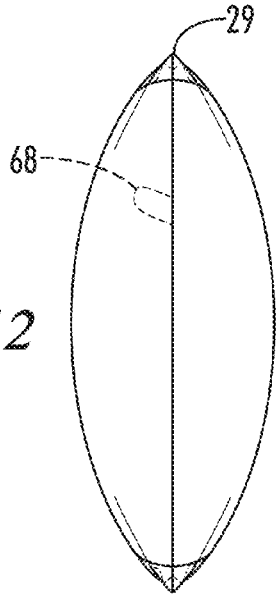
FIG. 12 is a back plan view of a pillow made from a pillow shell according to the present invention.
Figure 13:
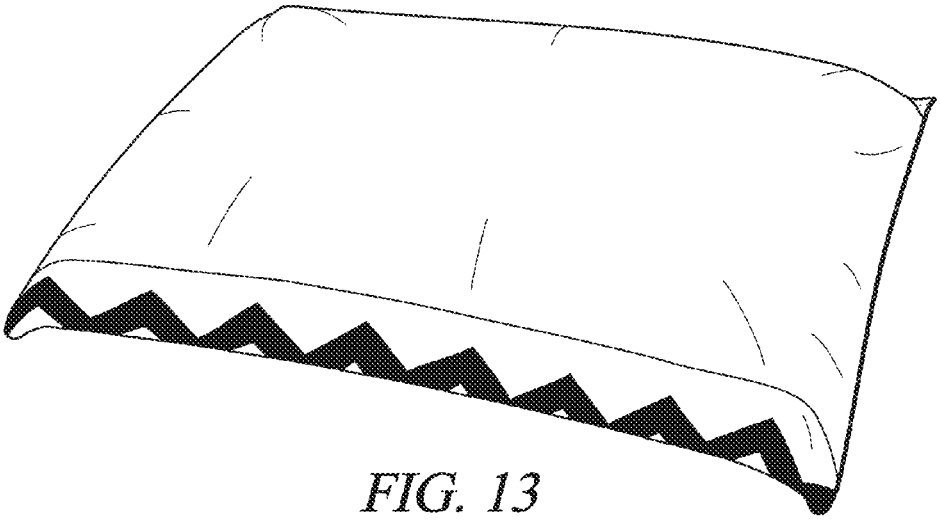
FIG. 13 is a perspective view of a pillow made from a pillow shell according to the present invention.

After laying out the fabric panels, the left lateral edge 43 of downward facing first gusset 40 is sewn to the left outward facing lateral edge 32 of the back panel 30 along first lateral seam 37 while the right lateral edge 52 of downward facing second gusset panel 50 is sewn to the right outward facing lateral edge 33 of back panel 30 along second lateral seam 38. The seams are sewn approximately one-fourth inch inward from the lateral edges of the panels so that there is an approximately one-fourth inch fabric allowance or inlay from each panel. The first and second lateral seams 37, 38 result in the assembly shown in FIG. 2 where gusset panels 40, 50 have been attached to back panel 30 along those seams 37, 38. The back or inward facing sides 41, 51 of gusset panels 40, 50 are facing upward. First gusset panel 40 is then folded to expose its outward facing side 44 as shown in FIG. 3 and outward facing left edge 42 of gusset panel 40 is sewn to the left edge 23 of downward facing top panel 20. This provides the third lateral seam 27 shown in FIG. 4. Next the second gusset panel 50 is folded open to expose outward facing side 54 and right side 22 of top panel 20 is sewn along right upward facing lateral edge 53 of second gusset panel 50 resulting in fourth lateral seam 28 shown in FIG. 5 still leaving inward facing side 21 of top panel 20 exposed. The result is a four panel loop of fabric, where panels are joined at lateral edges along lateral seams 27, 28, 37, 38 and that is open at each end as shown in FIG. 5. Next, the fabric loop is flattened with folds at the midpoint of the gusset panels 40, 50 and a fifth seam 29 is sewn transversely across transverse edges 26, 36, 46, 56 of the panels, closing one end of the fabric loop as shown in FIG. 6. At this point, the sack formed by the panels is inverted or turned right-side out, so that the exterior sides 24, 34, 44, 54 of the four panels 20, 30, 40, 50 are placed on the outside and the stitches and inlay of the first five seams are on the interior. An appropriate amount of fill 60 is then added to the pillow cover as shown in FIG. 7 and the remaining open end formed by transverse panel edges 25, 35, 45, 55 is sewn shut by serging or with whip stitching to form a sixth seam 39 (the second transverse seam) and resulting in pillow 67 shown in FIG. 8.

From this explanation, it can be seen that a pillow can be made from a pillow cover according to the invention with four rectangular panels of fabric and six straight seam lines. This results in minimal wasted fabric and is relatively easy to manufacture, involving only two more straight seams than the simplest pillows made from two rectangular fabric pieces.

A pillow made with a pillow cover according to the invention provides numerous advantages. Not only is a different shape and visual appearance provided at minimal extra cost in labor and material, but the visual and structural advantages of gusseting are provided. The additional middle fabric of a gusset allows the pillow to be bigger and thus contain more fill. It is desirable both to retailers and customers to have pillows that look thicker and the aesthetic element provided by gussets provides additional visual interest. Furthermore, when gusseted according to the present invention, using one to three inch wide gussets, pillows will fit within a regular pillow case without difficulty which is a problem with some alternative gusseted constructions.

The visual distinctiveness of the pillows with these pillow covers can be appreciated with respect to the drawings in FIGS. 9-13. Here it can be seen from the top plan view of FIG. 9 that the long or lateral sides 62, 63 of the pillows develop a significantly concave shape. This is due to a combination of factors. One factor is a tendency for the fill to be slightly concentrated in the center of the pillow so that the center has a more rounded shape than at the ends of the pillow. A second factor is that the straight transverse end seams 29, 39 tend to hold the ends of the pillows very close to the full width allowed by the fabric panels. So in the case of a pillow cover made from 17.5 inch wide front and back panels 20, 30 and 3.5 inch gusset panels 40, 50, this results in an 17 inch center panel formed from the front and back panels 20, 30 and two 1.5 inch edge segments formed from folded over gusset panels 40, 50, the total width then being approximately 20 inches at the end seams. In the middle of the pillow, the fabric of the panels takes on a rounded shape from the fill and therefore has less width. While standard four seam bed pillows have a slight concavity to their sides, gusseted pillow shells as described herein are significantly more concave. On a 20 inch wide standard pillow, the depth (or sagitta s) of the arc forming each concave side may be greater than 2.2, 2.4, 2.6, 2.8, or 3.0 inches. A typical width w of the center of a pillow with 20 inch wide end seams and 3 inch gussets would be between 14 and 15 inches. The concave sides present a distinctive appearance and functionally provide the most padding for the sleeper's head in the center of the pillow.

Indeed, although the filling machines utilized in manufacturing pillows are designed to provide a relatively uniform distribution of fill material within a pillow shell, two factors are at work that lead to redistribution of the fill. First, when a pillow shell is initially filled, the central portion of the shell can most easily assume a rounded configuration that holds more volume. This means that most pillows will have a slight tendency to concentrate the fill material in the center portion at initial fabrication. However, in use, sleepers usually position their heads in the center portion of pillows and the pressure and movement of the head will tend to force fill materials away from the center and toward the ends of the pillow. The present gusseted design improves upon both of these tendencies. When the pillow is initially filled, a greater proportion of the fill material is positioned within the middle 50% of the length of the pillow. In a standard pillow with 20 ounces of polyester fill material, this means that instead of half the fill material (10 ounces) being within the centermost 50% of length (10 inches) of the pillow as would be the case if fill were uniformly distributed, there is instead 12-14 ounces of material in this centermost region. Most commonly, 60%, 62%, 64%, 66%, 68%, or 70% of the fill material in the pillow is positioned within the central 50% of the overall length of the pillow. Furthermore, the gusseted structure tends to urge the fill material toward the central portion of the pillow shell, tending to counteract the action of the sleepers' heads to push the fill material towards the ends. The net result is more fill material in the central 50% of the pillow where sleepers most commonly rest their heads so that a pillow with 20 ounces of fill material performs with the feel of a pillow having 22-24 ounces of fill material. With fill material being a substantial expense in the manufacture of pillows, this performance benefit is a great commercial advantage.

It can also be seen that the entire gusset panels 40, 50 are utilized without the need for trimming as is the case when using oval gussets. This avoids the problem of portions of a print pattern on gusset panels being trimmed away and making it difficult to create pillows of uniform appearance without wasting substantial amounts of fabric. It can also be seen in FIGS. 10-12 that the gusset panels are visible from the side and front and rear views, and even at the edges from the top and bottom views of the pillow in FIG. 9. The fact that these gusset panels 40, 50 are visible means that if contrasting color is provided on those panels relative to the color of the main top and bottom panels 20, 30 a distinctive visual impression is made from any angle.

In most cases, the top and bottom panels 20, 30 are made from white or nearly white, fabric that presents a solid neutral background color and the most desirable visual impressions are made by gusset panels that combine the white or neutral background color with one or more other colors so that the white or neutral background color carries through on all panels of the pillow but the gusset panels provide additional accent color.

When pillows made according to this process are stacked, there is a slight compression because of the weight of the pillows, primarily upon the curvature of the top and bottom panels 20, 30 causing any accent pattern or color on the side gusset panels 40, 50 to predominate from the side view. This creates enhanced visual interest when stacks of pillows are placed in retail displays and generates added consumer interest.

Pillows are required in the United States to have attached labeling and the necessary labels may be attached along any of the six straight line seams. However, as a practical matter, these labels are generally attached along front or back transverse seams 29, 39. In fact, the easiest method of attaching the labels 68 is to insert them within the open ended loop shown in FIG. 5 formed after sewing the four panels together along their long edges and stitch the labels within that loop along the first transverse seam 29 when a sack is formed. Then when the sack is inverted, the labels will protrude from that bottom transverse seam 29. Although the order of sewing the four seams to attach the rectangular panels can be altered, depending upon the available equipment and manufacturing preferences of a particular factory or machine operator, very few other changes are available that would not reduce the efficiencies realized in this method of manufacture and the resulting gusseted pillows.

Pillow fill is most typically polyester, down, foam, or down alternative. Suitable fabrics for the panels forming the pillow cover may most commonly be cotton, microfiber, or synthetics such as nylon or polyester.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

What is claimed is:

1. A pillow comprising:

a pillow shell having a first and a second rectangular body panel, each a separate piece of fabric with first and second lateral edges of a predetermined length and transverse edges of a predetermined width;

a first and a second rectangular side panel each a separate piece of fabric with first and second lateral edges of the predetermined length and transverse edges of a lesser predetermined width;

wherein the first lateral edges of the first and second side panels are sewn respectively to the first and second lateral edges of the first body panel to create first and second straight lateral seams and the second lateral edges of the first and second side panels are sewn respectively to the first and second lateral edges of the second body panel to create third and fourth straight lateral seams;

the body panels and side panels connected by the first, second, third and fourth straight lateral seams defining a tube; and a first transverse end seam closing one end of the tube, said end seam connecting a transverse edge of each of the first and second body panels and folded transverse edge of each side panel upon itself;

wherein the first and second rectangular side panels have at least one color distinct from the first and second rectangular body panels, the inlay of each of the four straight lateral seams and the first end seam is on the interior of the closed ended tube; and fill material within the closed ended tube, and a second end seam connecting a transverse edge of each of the first and second body panels and folded transverse edge of each side panel upon itself at the opposite end of the tube from the first end seam closing the second end of the fabric tube with the fill material positioned such that a top plan view of the pillow shows that the straight lateral seems are concave curves between the first and second end seams.

2. The pillow of claim 1 wherein the inlay for the four straight lateral seams and the first end seam is approximately ¼ inch from the edge of each of the rectangular body panels and rectangular side panels and the inlay of these five seams is interior of the fabric tube.

3. The pillow of claim 1 wherein the body panel predetermined length of the lateral edges is selected from the group of approximately 26.5 inches, 28.5 inches, 30.5 inches, 36.5 inches, 54.5 inches, and 60.5 inches.

4. The pillow of claim 1 wherein the predetermined width of the rectangular side panels is selected from the group of approximately 1.5 inches, 2.5 inches, and 3.5 inches.

5. The pillow of claim 1 wherein a top plan view of the pillow shows concave sides between the first and second end seams, wherein each concave side is formed of an arc having a sagitta of at least 12%, 13%, 14%, or 15% of the predetermined width of the first and second body panels.

6. The pillow of claim 1 wherein the body panels are comprised of a solid neutral color fabric and the rectangular side panels are comprised of patterned fabric having the same neutral color for a background and at least one visually distinct color in a pattern on the fabric.

7. The pillow of claim 1 wherein the fill material is concentrated in the center portion of the pillow.

8. The pillow of claim 1 wherein at least 66%, 68%, or 70% of the fill material in the pillow is positioned within the central 50% of the overall length of the pillow.

9. A method of manufacturing a pillow from first and second rectangular body panels each with first and second lateral edges of a predetermined length, transverse edges of a predetermined width, and a first surface to be outward facing and a second opposite surface to be inwardly facing in the assembled shell; first and a second rectangular side panels each with first and second lateral edges of the predetermined length, transverse edges of a lesser predetermined width, and a first surface to be outward facing and a second opposite surface to be inwardly facing in the assembled shell, and a fill material, comprising the steps of:

placing the first lateral edge of the first rectangular side panel along the first lateral edge of the first rectangular body panel such that the outward facing surface of the first rectangular side panel is overlaying and facing the outward facing surface of the first body panel;

sewing a first straight lateral seam along the first lateral edges of the first rectangular side panel and the first rectangular body panel to connect said panels;

placing the first lateral edge of the second rectangular side panel along the second lateral edge of the first rectangular body panel such that the outward facing surface of the second rectangular side panel is overlaying and facing the outward facing surface of the first body panel;

sewing a second straight lateral seam along the first lateral edge of the second rectangular side panel and second lateral edge of the first rectangular body panel to connect said panels;

folding open the first rectangular side panel along the first straight lateral seam to expose the outward facing surface of the first rectangular side panel;

placing the first lateral edge of the second rectangular body panel along the second lateral edge of the first rectangular side panel such that the outward facing surface of the second rectangular body panel is overlaying and facing the outward facing surface of the first rectangular side panel;

sewing a third straight lateral seam along the first lateral edge of the second rectangular body panel and the second lateral edge of the first rectangular side panel to connect said panels;

placing the second lateral edge of the second rectangular body panel along the second lateral edge of the second rectangular side panel such that the outward facing surface of the second rectangular body panel is overlaying and facing the outward facing surface of the second rectangular side panel;

sewing a fourth straight lateral seam along the second lateral edges of the second rectangular body panel and the first rectangular side panel to connect said panels, thereby forming a tubular structure of alternating rectangular body panels and rectangular side panels with the outward facing surfaces of the panels on the interior of the tubular structure;

placing the first transverse edge of the first rectangular body panel along the first transverse edge of the second rectangular body panel and positioning the outward facing surface of the second rectangular body panel to be overlaying and facing the outward facing surface of the first rectangular body panel;

laterally folding the outward facing surface of the first rectangular side panel upon itself so that the first transverse edge of said panel is folded upon itself;

laterally folding the outward facing surface of the second rectangular side panel upon itself so that the first transverse edge of said panel is folded upon itself;

sewing a first transverse seam across the folded first transverse edge of the first rectangular side panel, the first transverse edges of the first and second rectangular body panels, and the folded first transverse edge of the second rectangular side panel to close an end of the tubular structure;

inverting the tubular structure so that the outward facing surfaces of the rectangular panels are on the exterior of the tubular structure;

inserting a fill material into the tubular structure;

placing the second transverse edge of the first rectangular body panel along the second transverse edge of the second rectangular body panel;

folding the second transverse edge of the first rectangular side panel upon itself;

folding the second transverse edge of the second rectangular side panel upon itself;

sewing a second transverse seam across the folded second transverse edge of the first rectangular side panel, the second transverse edges of the first and second rectangular body panels, and the folded second transverse edge of the second rectangular side panel to enclose the fill material within the tubular structure formed from the rectangular side and body panels such that a top plan view of the pillow shows concave sides between the first and second transverse seams.

10. The method of manufacturing a pillow of claim 9 wherein a first edge of a label is inserted between at least one of the (i) first transverse edge of the first rectangular body panel and the first transverse edge of the second rectangular body panel; (ii) the folded first transverse edge of the first rectangular side body panel; and (iii) the folded first transverse edge of the second rectangular side body panel, prior to sewing the first transverse seam, and sewing the first edge of the label into said first transverse seam.

11. The method of manufacturing a pillow of claim 9 wherein each of the four straight lateral seams and the first transverse seam has an inlay, and the inlay of each seam is on the interior of the tubular structure.

12. The method of manufacturing a pillow of claim 9 wherein the first and second rectangular body panels are comprised of a solid neutral color fabric and the first and second rectangular side panels are comprised of patterned fabric having the same neutral color as a background and at least one visually distinct color in a pattern on the fabric.

13. The method of manufacturing a pillow of claim 9 the predetermined length of the lateral edges of the first and second rectangular body panels and the first and second rectangular side panels is selected from the group of approximately 26.5 inches, 28.5 inches, 30.5 inches, 36.5 inches, 54.5 inches, and 60.5 inches.

14. The method of manufacturing a pillow of claim 9 wherein the predetermined width of the first and second rectangular side panels is selected from the group of approximately 1.5 inches, 2.5 inches, and 3.5 inches.

15. The method of manufacturing a pillow of claim 9 wherein the second transverse seam is serged.

* * * * *